United States Patent [19]

Thorsen

[11] Patent Number: 4,576,274

[45] Date of Patent: Mar. 18, 1986

[54] MEANS FOR THE STORING OF CARTS SUCH AS SHOPPING CARTS

[75] Inventor: Kjeld Thorsen, Floda, Sweden

[73] Assignee: Cart-O-Matic Aktiebolag, Stenungsund, Sweden

[21] Appl. No.: 498,589

[22] Filed: May 26, 1983

[51] Int. Cl.[4] ..... G07F 7/00

[52] U.S. Cl. ..... 194/210; 186/62; 194/905

[58] Field of Search ..... 194/4 R, 4 C; 186/62; 280/33.99 C; 414/227; 221/298

[56] References Cited

U.S. PATENT DOCUMENTS 3,978,959 9/1976 Muellner ..... 221/298 X
4,377,227 3/1983 Sandford ..... 194/4 R
4,427,893 1/1984 Gillet ..... 194/4 C

FOREIGN PATENT DOCUMENTS 0077690 4/1983 European Pat. Off. .
3112655 10/1982 Fed. Rep. of Germany .
3130543 2/1983 Fed. Rep. of Germany .

*Primary Examiner*—Stanley H. Tollberg

[57] ABSTRACT

A system for the disposition of shopping carts including at least one storage area for carts, which are intended to be removed and returned from the storage area by users. Each storing area has at least one gate in an outlet passage to permit a cart to pass therethrough only if a deposit is received and a gate in an inlet passage to permit cart to pass therethrough if identified as authorized, in which event the deposit is repayed.

5 Claims, 7 Drawing Figures

MEANS FOR THE STORING OF CARTS SUCH AS SHOPPING CARTS

The present invention relates to a system for storing and controlling the flow of shopping carts in self service markets.

In self service markets shopping carts are available to the customers. The cart is fetched in a storing place by the customer and brought to the store for collection of the articles the customer wants to purchase. The cart is then brought to a place where the customer empties the same for the further transport of the goods for example by means of the customer's own car. The basic object of the invention is that the customer after emptying the cart shall return the same to the storing place.

However, many customers will not return the cart but leave the same far from the storing place in another place where it is more convenient to leave the cart. Some carts are also stolen for private use or left in a public area where they are collected by the public cleaning department.

Thus there is a considerable loss of shopping carts in most super markets. There will also be considerable costs for the staff needed for the collection of the carts left in for example the parking area outside the storing places. A further inconvenience in this connection is that arriving customers will have difficulties to find a cart if the carts not in use are spread over a huge area.

In order to cope with these problems special storing means have been designed. According to one system the carts in the storing place are locked and are only available to the customers after paying a deposit in the form of a coin or a token. The deposit is then paid back at least partly when the cart is returned to the storing place and locked again. This system, however, has many disadvantages. The placing of the cart in the locking means and locking the same is inconvenient as well as the unlocking and removal of the cart from the locking means. The locking means are easily damaged and a lock which is not functioning can block an entire row of carts in the storing place. The great number of locking means required, i.e. one for each cart creates considerable risk for breakdown and also considerable initial and maintenance costs.

The object of the present invention is to provide a system for the storing and the administration of carts as controlling the flow of shopping carts which is more convenient for the customers than prior known systems.

Another object is to provide a system which is more reliable and easier to maintain than prior known systems.

A further object is to provide a system which will provide control over the distribution of the carts over a large area including several storing places for the carts.

The objects of the invention are achieved by means of a system according to which the carts are stored in areas without any connection to locking means. The transport of the carts out from and into the area is directed through gates provided to control the paying of deposits, the payback of deposits and the identity of the carts.

In the accompanying drawings three embodiments of the invention are shown together with some details of the storing means.

In FIGS. 1–4 the three embodiments of the invention are shown in the form of block diagrams with FIG. 4 relating to a detail of the means of the embodiment according to FIG. 3;

Figure 1:
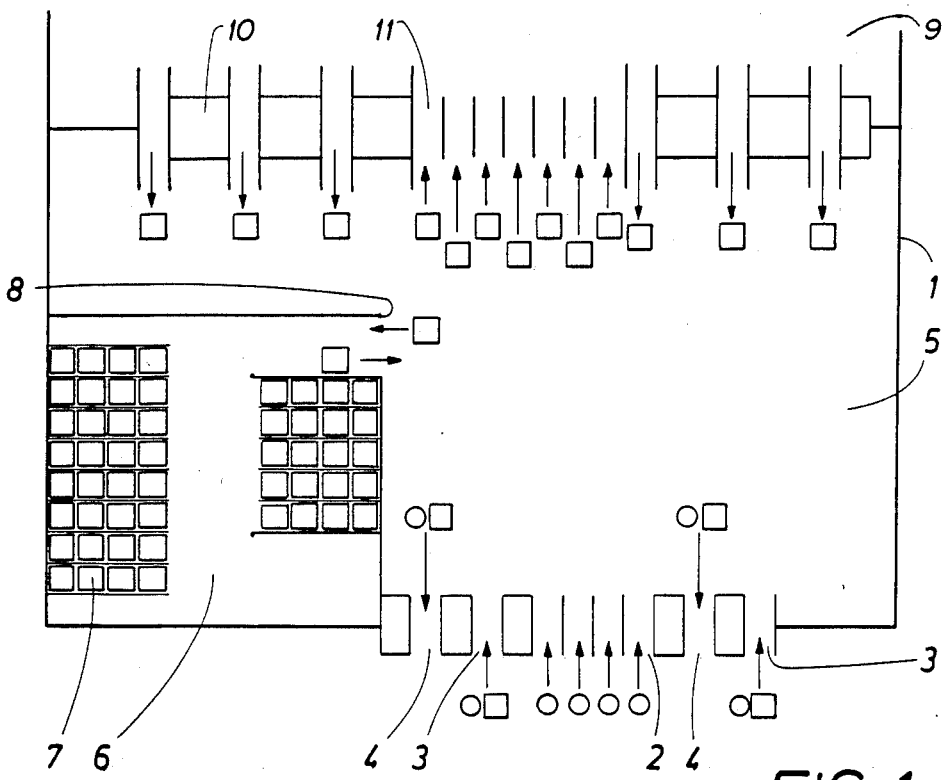

In FIG. 1 a schematic plan view of the entrance to a super market is shown. The line 1 represents the outer wall of the building containing the super market. At the front of the building a number of entrances 2 are provided. The entrances 2 are intended for customers which are not bringing a cart along but there are also controlled entrances 3 for customers bringing in return emptied carts (in the views according to FIGS. 1–4 those persons who are not bringing a cart are indicated by a circle and persons pushing a cart are indicated by a square). There are also a number of exits 4 intended to let the customers out without or together with a cart.

In the entrance hall 5 an area 6 is reserved for the storing of empty carts in rows 7. This area is accessible through a gate 8 in the entrance hall for the collection and return of the carts. The storing area 6 is not accessible from the outside of the building.

The entrance area 5 is separated from an exit area 9 where the articles to be sold are purchased at a number of check out counters 10 after passing through a series of inlet gates 11. As indicated in FIG. 1 the intention is that the customers bring a cart along through the gates 11 and that the goods are brought out through the check out counters 10 by means of the carts.

The gates 3 and 4 are automatically controlled gates. Gates 4 are outlet gates which are provided to mechanically stop a cart when it is brought to the gate until a deposit for the cart has been paid. The gates 3 are inlet gates and are also provided to stop a cart when it is brought to the gate. After identifying the cart if it belongs to the market in question, the gate will give free way for the cart if it is approved and will also pay back the deposit or a part of it when the cart is passing through the gate. Preferably both types of gates are provided to leave free passage way for a person who is not bringing a cart along.

Figure 2:
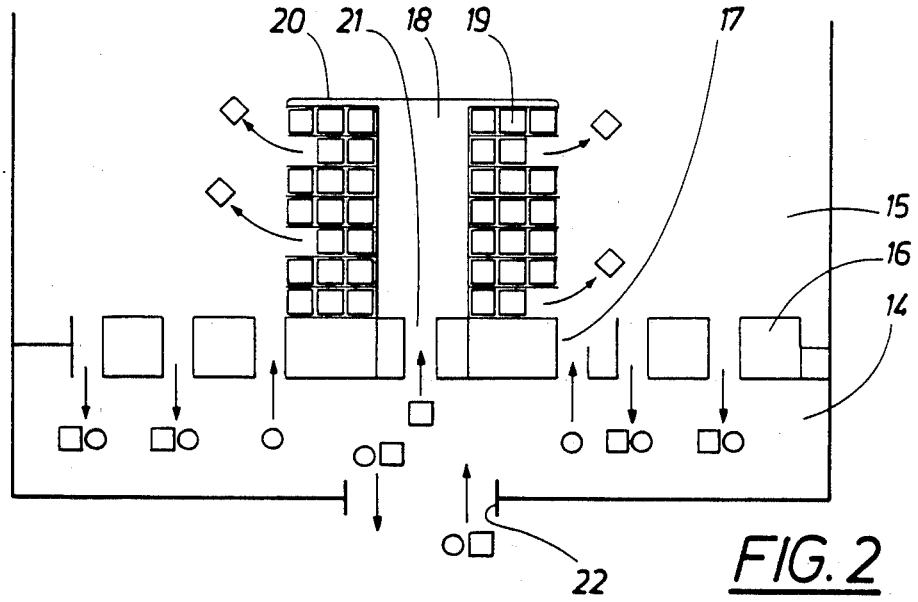

In another type of market according to FIG. 2 an entrance area 14 is divided from an area 15 where the wares are displayed and purchased through a number of check out counters 16; and two inlet gates 17 are provided for persons. An area 18 is reserved for the storing of rows 19 of carts. The area 18 is accessible from the entrance area 14 through a controlled gate 21. From purchase area 15 the area 18 is accessible for the fetching of carts by customers entering the area 15 through the gates 17. There is free accessibility to the carts from the purchase area 15. The entrance 22 to the entrance area 14 has no control means and comprises a free passage way.

In this embodiment the check out counters 16 are provided as control gates with indicating means registering each cart passing through the check out counter. For each registration of a cart the count for the articles in the cart passing through the gate is added to a deposit sum for the cart. The indication that a cart is brought to the check out counter will consequently actuate the cash register to add a deposite sum to the bill of costs for the purchase. In other words, for every cart brought through one of the check out counters a deposit has to be paid.

The control gate 21 is of the kind described before, i.e. when a cart is presented in this gate. When returning a cart through control gate 21 the identity of the cart is registered and if the cart is approved, the stopping means in the gate will let the cart through and the deposit is paid back. If a person has entered the area 18 in order to return a cart he must also be let out. The outlet can be through the control gate 21 if the same is provided to let a person but not a cart out, but not if the area 18 is accessible for persons in the purchase area 15 as it would make it possible to carry goods out through the control gate. The area 18 can however be divided from the purchase area 15 by means of a fence 20 in the form of a bar under which the carts can be drawn out from the area 18 into the purchase area 15 but which make it difficult for persons to pass in the reverse direction especially if rows of carts are stored behind the fence. Another possibility is to direct persons entering through the control gate 21 to leave the area 18 through a check out counter or a gate with personnel controlling their passage. In this case the fence can be spared. Of course the storing area can be placed at one of the side walls or in a corner instead of in the center of the building.

Figure 3:
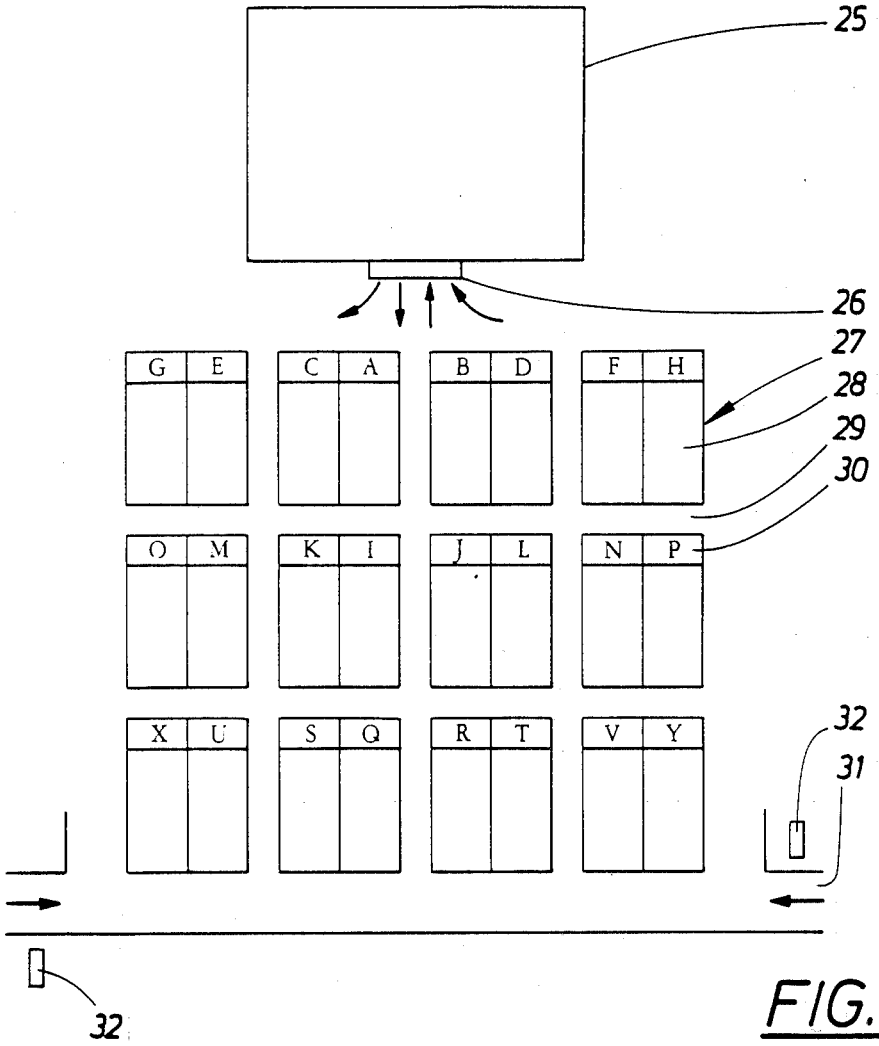

In FIG. 3 a huge super market is shown. A building 25 contains the market proper and the building has an entrance and exit arrangement 26 for the customers. Outside of the building is a parking area 27 which is divided in part into areas 28 and provided with a network of drives 29. To each part of the area a storing area 30 is provided for a number of shopping carts. The areas 28 for the parking and the storing areas 30 for the shopping carts are indicated A–Y with A, B . . . indicating the areas nearest the entrance 26 and . . . V, Y indicating the areas with the greatest distance to the entrance. The storing areas 30 for the carts are adapted to contain a number of carts adapted to the number of motor cars which will find room in the parking area 28. In practice, the number of carts will be the same as the number of parking places added with a small number of carts as a reserve for damaged carts and for customers who are arriving together in the same car.

The parking area 27 is accessible from a feeder road 31 provided with information displays 32.

Figure 4:
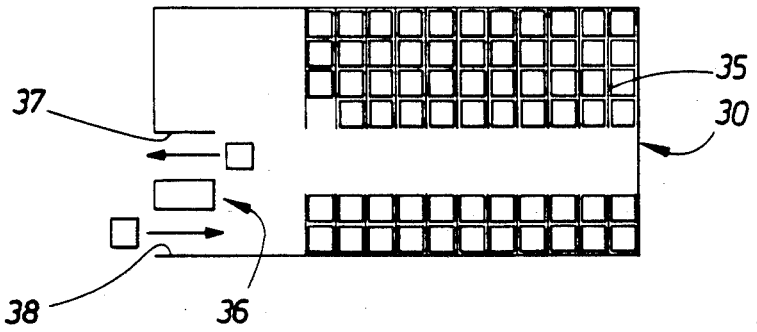

In FIG. 4 one of the storing areas 30 for the carts is shown in an enlarged scale. The area contains space for a number of rows 35 for the shopping carts. A double control gate 36 is provided with a gate 37 for the outlet of the carts. This gate, as has been described before, is provided to stop the passing of a cart out from the area until a deposit is paid. A second gate 38 is provided to identify a cart brought to the gate and to let the same through and out of the area if it is approved and to pay back the deposit when the cart has passed the gate. Also this kind of gate is described before.

Figure 5:
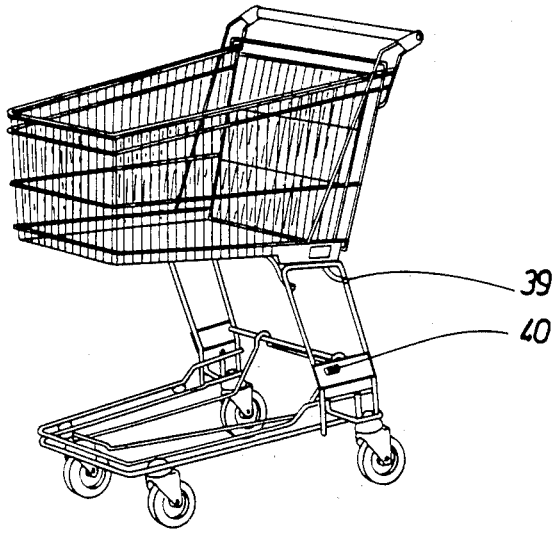
FIG. 5 shows a shopping cart adapted for use together with the storing means and shown in a perspective view.

In FIG. 5 a shopping cart is shown, and many kinds can be used in the system as long as each cart is according to FIG. 5 provided with an identifying means 40 at the side of the cart. This identifying means can be of an optic type e.g. E.A.N. code or magnetic type or in the form of a hybride circuit or any other means for contact free identification.

Figure 6:
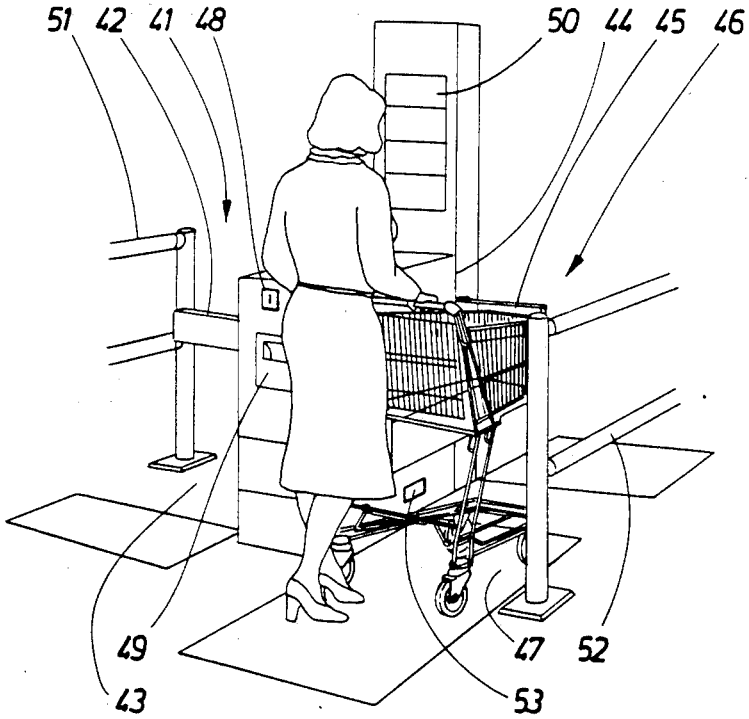
FIG. 6 shows a detail of the storing means in a perspective view.

In FIG. 6 a double gate of the type indicated by reference number 36 in FIG. 4 is shown. It comprises an inlet gate 41 including a barrier in the form of a retractable bar 42 which will stop the passing of a cart as long as it is not retracted from the passageway 43 through the gate.

The bar is carried by a housing 44 for the gate mechanism. This housing also carries on the opposite side the bar 42, a second bar 45, provided as a barrier in a second gate, having an outlet gate 46 opening on a passageway 47. The housing is also provided with a slot 48 for a coin or a token representing the deposit for the cart and a cup 49 for paying back the deposit. Each passageway is provided with sensors for the identification of the carts entered into the gate provided for governing of the mechanism of the gate according to the desired function which will be described later. The housing 44 can also be used for the carrying of an information display 50.

Opposite the side walls of the housing 44 the passage ways 41 and 46 are defined by means of fences 51 and 52.

Figure 7:
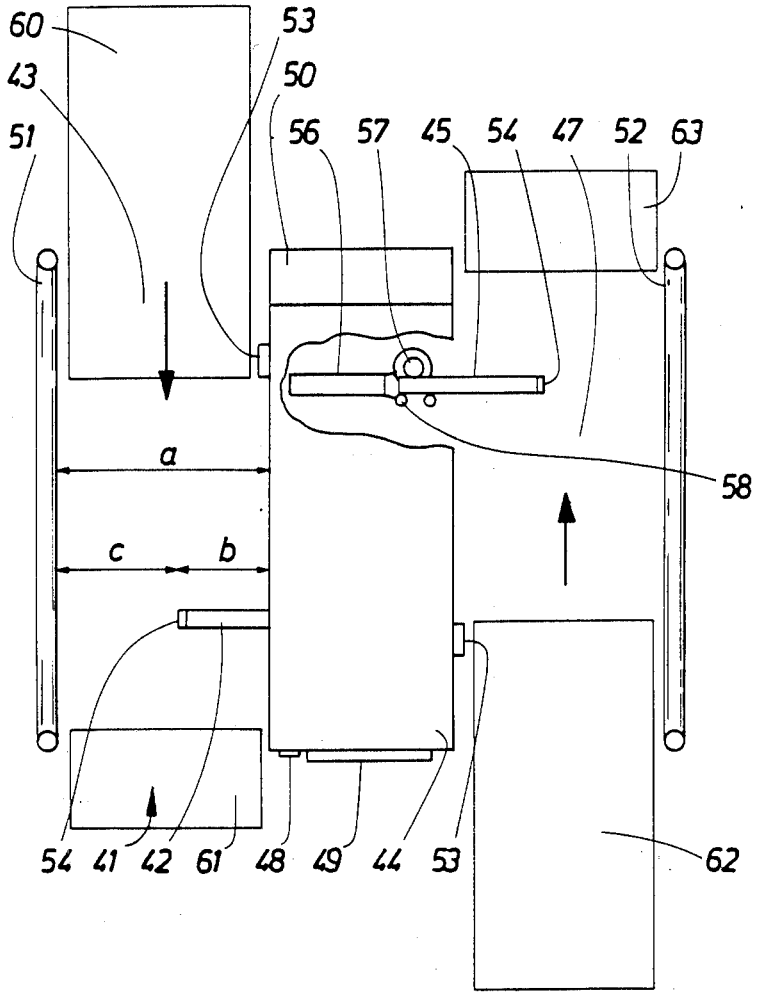
FIG. 7 shows the same detail in a plan view.

FIG. 7 shows a double gate from above. In this view, it is shown that the bars 42 and 45 are provided with photocells 54 at the outer end of each bar. The side walls of the housing 44 are provided with sensors 53 in the inlet of both passage ways 43 and 47. The width of the passageway is indicated at 43. Thus a indicates the full width of the passage; b the length of the bars 42 and 45 respectively and c the free width of the passage way between the end of the bar and the fences 51 or 52 respectively. The intention is that the measure c is so chosen so that the opening between the bar and the fence will let a person through but not a cart. The measure a is so chosen as to let a cart through which means that a person can pass the gate without any manouvering of the bar but a cart can not pass through the gate before the bar has been retracted. As the width of the cart is about 50 cm, it is suitable if the measure a is 70 cm and the length of the bar b is 30 cm which leaves 40 cm free way, c.

In FIG. 7 is shown by way of example a mechanism for the retraction of the bar. The broken upper side of the housing 44 shows that the bar is guided in a sleeve 56 and is pressed between a driving roller 57 and two supporting rollers 58. The driving roller 57 is rotatable by means of an electric motor so that the bar can be drawn in and out between the outer position shown and an inner position in which the bar is retracted into the housing. The outward movement of the bar is controlled by the photocell 54 which will stop the pushing out of the bar if any object is in the way. The photocell can be replaced by a sensing means as electric capacity means provided to stop the movement if the end of the bar is hitting any object.

The passages of the gates are provided with step contact mats, 60, 62 in the respective inlet ends of the passages 43 and 47 of a first type and mats 61 and 63 respectively of a second type in the outlet end of the passages.

The first type of the step contact mats at the inlet ends are sensing means provided to be activated by a pressure on the mat indicating that anybody stepping on the same or that a cart is rolled up on the same. This sensing means can be of a known electric contact type in which electric contacts are pressed together to close a circuit when a flexible surface layer as a web of rubber is pressed downwards by the weight of the person or the cart passing through the passage.

Preferably a row of sensing means is positioned one after the other in the traffic direction. By connecting the electric contacts of the sensing means to a device registering the period of time between the impulses in sequence from the contact means when an object is passing the mat, the velocity of the object can be determined. This velocity will in turn determine a suitable period between the first impulse when the person or the cart is reaching the mat and the opening of the retractable bar as well as closing of the same. In this way it can be assured that the bar is not open for longer periods than necessary to permit good control of the passing but in spite of this the bar will not be an obstacle to passing of a person without a cart.

The mats 60 and 62 are also provided with magnetic sensing means provided to react on the mass of metal in a cart brought up on the mat. The magnetic sensing means are provided to bring the identifying sensing means 53 into an active state if it is indicated that the metal mass corresponds to about the mass of one single cart of the intended type or types. It is not possible to make the magnetic sensing means so selective that all different types of carts or similar metal objects as baby carriages can be fully differentiated from each other. The main part of the "strange objects" can be selected from the carts of the store in question and it can also be indicated if anyone tries to bring a couple of carts together through the gate.

Consequently, the magnetic sensing means are provided to bring the identifying sensing means 53 to identify each object as a shopping cart by the magnetic sensing means. If this cart is identified by the sensing means 53 as belonging to the storing area in question the cart is approved and the bar 42 and 45 respectively will be retracted so that the cart can pass. If the magnetic sensing means identifies the object as more than one cart the bar will not be retracted but the display 50 will be activated to show that only one cart at the time will be brought through the gate. If the magnetic sensing means identifies the object as not being a shopping cart or carts, the object does not belong to the market and has to be let through the gate and no identifying by the sensing means 53 is necessary.

In the same way as the bars 42, 45 are activated by the magnetic and identifying sensing means the mechanism for receiving and paying back the deposit is activated. As has been described before a deposit has to be paid in the deposit receiving means 48 before a cart identified as a shopping cart belonging to the market can pass through the gate. To accomplish this step control contacts are provided to adapt the opening of the bar to the sequence obtained when the cart is passing over the mat. If the object is identified as of another kind than a shopping cart paying of a deposit is not necessary for activating the bar to open.

In the same way the paying back of the deposit will only occur when an object identified as a shopping cart belonging to the market in question is indicated as passing.

The step control mats 60, 63 at the outlet end of the passage way are provided to bring a termination of the passing operation. When these mats have been passed the respective bar has to be closed. The mat 61 is also provided to activate the paying back of the deposit so that the same will be available in the means 49 when the person bringing the cart reaches the outlet end of the passage way 41.

The mats 61 and 63 are also provided to indicate if anybody tries to pass the gate in the wrong direction. For this purpose the mats can be provided with more step control contacts which, when activated in an order indicating that anyone has been passing over the mat in the unintended direction, will close the bar and activate the display 50. The bars 42, 45 can, in order to stop also persons not bringing a cart, be provided to be pushed outwards in order to entirely close the passage way, i.e. the bar is not only extending out in the passage way by distance b but the entire distance a.

Identifying means have been mentioned. The identifying means 40 on the carts 39 are of the passive type mentioned. Such identifying means are provided to be read by an active identifying means, the sensors 53. The reading can be made by means of a light beam or by means of magnetic or electromagnetic impulses according to the system chosen. Such technique is well known and will not be described further. However, the intention of identifying the cart is that only carts identified as belonging to the storing area proper will be approved to pass an inlet gate. Consequently the storing areas A–Y in FIG. 3 are provided with carts with an identification which is exclusive for the specific storing area. Thus, a cart belonging to the area B cannot be introduced into the area A or any other area than B. Such identification can further be used to register different types of carts, for example small and large basket carts and platform carts. By the most extensive use of such identification each cart has an individual identification making it possible to control the entire stock of carts according to age, period since last service and similar conditions.

The double gate functions as follows:

When a cart is removed from one of the rows of carts in the storing area and pushed into the passage way 47 of the outlet gate, the contacts of the mat 60 activate the magnetic sensing means. If the magnetic sensing means indicates that a cart belonging to the market is going to pass the passage the identifying sensing means 53 will identify the cart. At the same time the display 50 is informing the customer that he has to pay the deposit in the receiving means 48 and when the deposit is paid the bar 45 will be retracted so that the cart can pass. As mentioned before the bar preferably is retracted as long as no cart is introduced in the passage way but will be pushed out to the position shown in FIG. 7, consequently the distance b when a cart is introduced. The bar then will be retracted after the deposit is paid and the cart is identified. This registration gives an impulse to the driving motor for the bar 42 to push out the bar, which when not activated is open, consequently retracted into the housing 44. In the outer position of the bar carts can not pass the gate. Simultaneously with the closing of the gate it is indicated on the display 50 that the customer has to pay the deposit by inserting a coin or a token in the slot shown at 48 on the front of the housing 44. When the deposit is paid, the bar 45 is retracted and the cart can pass. At the same time it is registered, as will be described later, that a cart is taken away from the storing area.

When the person pushing the cart is passing the mat 63 the bar 45 is brought to its resting position, i.e. it is retracted but ready to be pushed out when another cart is introduced in the passage.

When a customer wants to return an empty cart, it is pushed into the passage 43 of the inlet gate 41. The sensors of the mat 60 register that a cart is introduced in the gate. The identification of the cart by means of the sensor 53 determines whether or not the same belongs to the specific storing area. If the identification is correct the cart is approved and can pass through the gate, which normally is open as the bar 42 normally is retracted into the housing 44. If however, the cart does not belong to the storing area in question, the bar 42 is pushed outwards so that the cart cannot pass. At the same time it is indicated in the display 50 that the cart has to be stored in another area or that it does not belong to the super market at all. If the cart is approved and is pushed through the gate the mat 61 registers the passing of the cart and the deposit or a part of the same is paid back in the means 49.

It is necessary that the passing through the double gate is so directed that it follows the intended traffic direction (see the arrows in FIG. 7). This is as mentioned made by means of the step contact mats 60, 62 in the inlet end of each passage which will indicate if anybody tries to pass the gate in the wrong direction. If so, the bar in the gate is pushed out over the entire width of the gate so that it is not even possible for a person without a cart to pass the gate. When a person intends to pass one of the gates in the right direction not bringing a cart along, the bar normally is open. If a cart has just passed or is entering the passage way and the bar is closed, it is possible for a person to pass between the end of the bar and the fence. The measure c indicates the minimum width of the free way adapted to let a person through the gate also when the bar is in closed position. That means that passing of persons will not be stopped even if the mechanism will break down with the bar in its outer position.

The described function relates to a gate such as the double gate 36 for the storing area 30. In the plan according to FIG. 1 each one of the outlet gates 4 is equal to the outlet gate 46 described and belonging to the double gate in FIG. 7. The inlet gate 3 is equal to the inlet gate 41 in FIG. 7 and has the same function. Also the inlet gate 21 of the plan in FIG. 2 has the same function as the gate 41 of the double gate. However, the gates at the check out counters 16 do not have the same function but the automatic debiting of the deposit in the check out counter is described before. As the check out counters are manned, any automatic stopping means are not necessary.

As the carts can be identified and registered when leaving the storing area and when returning to the same, a number of functions can be provided. As mentioned before the carts can by means of their identifications be distributed if several storing areas are provided so that the customers are prevented from returning the cart to another area than the same it belongs to. In this way, the right number of carts can always be available in different storage areas so that one of the storing areas is not empty when some storage places in another storage area still are free and, at the same time another storing area is overloaded. It is also possible to calculate from the number of outpassing and inpassing carts, the carts available in each specific storing area. This possibility can be used to alert the staff, if a specific storing area is empty.

Furthermore, as the number of carts in a specific storing area can be used to estimate the number of free parking places in a nearby area it is possible to direct the incoming cars to the areas where parking places are available. This possibility is inherent in FIG. 3 by means of the display unit 32 at the ends of the feeder drives. Most of the customers want to park as near as possible to the entrance and in rush hours a lot of cars usually are driving around searching for parking places near the entrance. By means of the control system mentioned, it is posible to register where carts are available and also where parking places are free so that each incoming car can be directed to a free parking place as near as possible to the entrance. Consequently, by indication of free parking places to the driver preference will be given to parking areas indicated with letters in the beginning of the alphabet (see FIG. 3).

The system also makes it possible to register if carts are lost so that replacements can be made. As mentioned before, it is also possible to follow the "disposition" of each individual cart if desired.

The main object of the described system and an object which is common to all the embodiments is the influence on the customers to return the carts to the storing areas where they belong after the cart has been used and is emptied. This is achieved by means of a suitable deposit paid when the cart is fetched which deposit is paid back only if the cart is returned to its specific storing area. This is accomplished by the storing means according to the invention in a way which is very convenient for the customers as the carts only have to be pushed through a gate when fetched and returned. There is no locking means to handle. The possibility of identifying the carts when passing the gates make it, as described before, possible to control the handling of the carts as well as the parking activities. As the carts are provided with identification means it is also possible to sense if any cart is passing the borders of the market area so that an alarm that a cart is going to be stolen can be activated.

If more sophisticated means to control different activities are utilized, it is necessary to connect the control gates to a computer. This computer has to be provided to register the leaving and returning of the carts in the different storing areas and to calculate the remaining number of carts in the area. By means of this calculation an alarm indicating that a storing area is emptied can be activated thereby directing of the traffic. From time to time the computer can produce a balance for the stock of carts as carts lost, carts in service and carts under repair, also reliability of carts from different manufacturers can be estimated.

There are a great number of computers available in the market which can be programmed for the function mentioned. It is, therefore, not necessary to describe a specific computer or the programming of the same as a person skilled in the art can select a suitable computer and program the same.

The control of the traffic of carts through the gates can also be used for still more sophisticated functions. For example the number of carts leaving the storing areas during a certain period can be used for an early alarm indicating the need of number of manned check out counters as well as when the number of incoming customers is not so great so that some check out counters can be closed. The necessity for the customers to pass the gates also enables the store to give the customers special information of current interest, occasions and so on. This information can be specific and related to the type of cart the different customers have chosen, e.g. customers choosing big basket carts will probably have a specific interest in certain commodities while customers choosing a platform cart are intending to buy large articles as furniture or kitchen equipment.

I claim:

1. A system for the disposition of shopping carts including an entrance area and at least one storage area for such carts which are intended to be removed from and returned to the storage area by users of the carts, comprising, for each storage area, at least one outlet gate and first control means to permit a cart to pass through said outlet gate only if a deposit is registered by said first control means, at least one inlet passage provided with an inlet gate and second control means to permit a cart to pass through said inlet gate only if said cart is identified as an authorized cart, said second control means being provided with sensing means responsive to actuating means carried by said cart to identify an authorized cart and to permit passage of said cart through said gate only when said sensing means so identifies an authorized cart and to refund at least part of the deposit, said storage area being open for free positioning of said carts in and out of said storage area, and at least one passage for permitting persons without carts free access to and from said entrance area, each gate comprising a housing forming on each side thereof a passage, each passage being provided with stopping means displaceable between an open position for free access of a cart and a closed position to prevent passage of a cart, means for the receiving of a deposit at said outlet gate, means for refunding a deposit at said inlet gate, active sensing means on a wall of said inlet passage formed by said housing to identify a cart presented in said passage, said cart being provided with a passive sensing means to actuate said active sensing means, and actuating means to control the stopping means in said outlet passage to an open position when a deposit is inserted in said deposit receiving means and to position said stopping means in said inlet passage to an open position when said sensing means has identified an authorized cart and to refund a deposit made when said cart was passed through an outlet gate.

2. A system according to claim 1 in which said inlet passage is provided with magnetic sensing means to identify the passing of a shopping cart by sensing the metal mass of said cart and to actuate said stopping means from an open to a closed position, said stopping means being at an open position until an object identified as a shopping cart is presented in said passage.

3. A system according to claim 1 in which said stopping means is in the form of a bar and means are provided to move said stopping means between open and closed positions such that said stopping means extends out over said passage by such a distance that a part of said passage permits a person to pass, while at the same time preventing a cart to pass.

4. A system according to claim 1 in which said passage is about 70 centimeters wide with the stopping means extending about 30 centimeters out over said passage in the closed position, thereby providing a free passage for a person of about 40 centimeters while at the same time preventing a cart to pass therethrough.

5. A system for storing shopping carts including several storage areas for carts which are intended to be removed from and returned to the respective storage areas by users, comprising for each storage area at least one gate provided with first control means in an outlet passage provided to permit a cart through only if a deposit is received by said first control means, and second control means in an inlet passage to permit a cart therethrough if identified by sensing means belonging to carts intended to be stored in a storage area and identified by said sensing means and in connection with the passing of the cart to refund a deposit, each storage area being connected to a parking area for motor cars with the intended number of carts in the storage area adapted to correspond to the intended number of motor cars in the connected parking area, the gate of each storage area being connected to computing means provided to register the number of carts as a reminder of the basic number of carts reduced by the number of carts registered in said gate as leaving the area and added to the number of carts registered in said gate as returned to the area, said computing means being provided to produce information indicating the number of carts available in the different storage area corresponding to the number of probable free parking places in the corresponding parking area.

* * * * *

UNITED STATES PATENT AND TRADEMARK OFFICE

CERTIFICATE OF CORRECTION

PATENT NO. : 4,576,274

DATED : March 18, 1986

INVENTOR(S) : Kjeld Thorsen

It is certified that error appears in the above-identified patent and that said Letters Patent are hereby corrected as shown below:

On the Title page, Item (73) should read:
(73) Assignee: Thorsen o Prytz Investment Handelsbolag
Stenungsund, Sweden

Signed and Sealed this

Twenty-eighth Day of October, 1986

[SEAL]

*Attest:*

DONALD J. QUIGG

*Attesting Officer*

*Commissioner of Patents and Trademarks*